United States Patent [19]

Carolus et al.

[11] Patent Number: 4,742,360

[45] Date of Patent: May 3, 1988

[54] POWER ANTENNA

[75] Inventors: David T. Carolus, Dayton; Winston C. Wilder; Robert E. Evans, both of Centerville, all of Ohio

[73] Assignee: General Motors Corporation, Detroit, Mich.

[21] Appl. No.: 822,484

[22] Filed: Jan. 27, 1986

[51] Int. Cl.[4] ..... H01Q 1/10

[52] U.S. Cl. ..... 343/903; 343/715

[58] Field of Search ..... 343/714, 715, 901, 903, 343/873, 900; 242/54 A

[56] References Cited

U.S. PATENT DOCUMENTS

| | | | |
|---|---|---|---|
| 2,346,728 | 4/1944 | Carlson | 343/903 |
| 2,491,601 | 12/1949 | Bernstein et al. | 343/901 |
| 2,953,934 | 9/1960 | Sundt | 343/903 |
| 4,128,965 | 12/1978 | D'Hondt | 343/901 |

FOREIGN PATENT DOCUMENTS

| | | | |
|---|---|---|---|
| 3338511 | 5/1985 | Fed. Rep. of Germany | 343/901 |

*Primary Examiner*—William L. Sikes
*Assistant Examiner*—Michael C. Wimer
*Attorney, Agent, or Firm*—Dean L. Ellis

[57] ABSTRACT

An automobile or like power operated radio antenna comprising a telescopic mast tube assembly fabricated of tough flexible polymeric material in tubular sections enclosing an inner metallic drive cable of helically coiled wire serving not only as the actuating cable for deployment of the antenna to and from an extended position but also as the conductive radio wave collector element.

4 Claims, 2 Drawing Sheets

POWER ANTENNA

This invention relates to radio antennas and more particularly to power-extensible and retractible radio antennas useful in automobiles and the like.

The present invention is a result of a search by the assignee hereof for solutions in such powered radio antennas for automobiles to avoid the problems of conventional prior chrome-plated brass or like metallic telescoping antenna masts subject to fracture when struck by garage doors, auto wash mechanisms, etc.

Further, it answers the result of a search for similar improvements in such antennas which have conventionally used polymeric drive cables enclosed within the telescopic mast and driven by a motor to extend and retract the same. The polymeric material of such cables has been chosen typically to present no impediment to the radio reception performance of the conductive metallic mast sections and also to provide adequate service and durability in the varying ambient conditions to which the automobile can be subjected. However, the experience with the best of available such polymers in those cables has not been uniformly satisfactory.

The present invention, embodied in as far as known the commercial first of its kind, provides an antenna having telescopic mast sections made of a tough, flexible polymer material fabricated in tubes enclosing an inner likewise tough and flexible metallic drive cable for extending and retracting the mast sections. For utmost simplicity and radio reception performance, the antenna drive cable also serves as the radio frequency wave receptor element.

An incidental and completely gratuitous mention of such an arrangement is made in the French Patent No. 1,081,711 issued December 1954. No disclosure is made nor appreciation evidenced therein of the substantial obstacles to practical accomplishment of satisfactory radio reception by use of a metallic cable serving the dual functions of a drive element for antenna deployment and radio frequency wave collection. Particularly, in the French disclosure fundamental difficulties remain unanswered as to how such a metallic cable can be employed as a drive element and still achieve effective transmission of collected radio waves for proper radio performance while in the presence of other metallic elements with which it is assembled as well as the usual ambient electromagnetic interference.

The present invention provides a power operated telescoping antenna in which a tough and flexible metallic push/pull cable is coiled upon a storage drum and its upper end enclosed within a telescopic assembly of tubular mast sections constructed of filament-wound fiber-glass reinforced polymeric material which is electrically insulative and pervious to radiation. When deployed above a car fender or similar ground plane object exposed to radiation, an upper length of the electrically conductive drive cable enclosed within the mast sections above such ground plane collects the radio waves for transmission to the remainder of the power antenna assembly below the vehicle fender, and ultimately to the radio receiver. This remainder of the assembly, in accordance with the invention, features simplicity, ruggedness and effective transmission of the collected radio waves for delivery to the radio receiver despite the difficulties enumerated above. Thus, the drive/collector cable is employed in an assembly featuring electrically grounded shield structure but in a manner isolating the cable from ground. Yet, this is accomplished with the further attribute of minimal capacitive coupling to the shield structure or other adjoining grounded elements. The cable includes an outer helically wound element meshed with a power-driven nut to extend and retract the antenna. For the simplicity and ruggedness of structural organization necessary to long life in a hostile environment, the above is accomplished in a way to cause cable motion and flexure during coiling and uncoiling on the storage drum to occur without undue stress or frictional or other resistance. Guidance of cable motion is further achieved in a structure which allows for but a single sliding or rubbing engagement point for transmission of radio waves to the radio receiver.

Moreover, in the prior art, actuating cables of this type required restraint at their lower end in order that a drive nut engaged thereupon would not cause frictional co-rotation of the cable on its own axis. Wise U.S. Pat. No. 2,926,351 and Barrett U.S. Pat. No. 2,299,785 are illustrative of the prior practices. In the present invention, the lower end of the conductive metallic drive cable is manipulable during manufacture and assembly as an element of a cable and mast section subunit which may be simply fed into the motor/drive nut subunit and guided into the storage drum of yet another subunit. No permanent attachment is made of the free end of the cable to such drum. Rather, the bending resilience and strength properties of the cable together with the surface properties of the interior of the drum are utilized such that, with at least a predetermined length of a normally straight such resilient cable coiled against the walls of the drum even in the fully extended antenna position, sufficient resistance is created to rotation of the cable on its own axis that proper operation of the unit will result. Simplicity of structure and ease of assembly are thus achieved, while also avoiding use of additional securement or wave transmission elements that could detract from maximum radio reception performance in a drive cable which doubles as an antenna.

These and other objects, features and advantages of the invention will be readily apparent from the following description and from the following drawings wherein.

Figure 1:
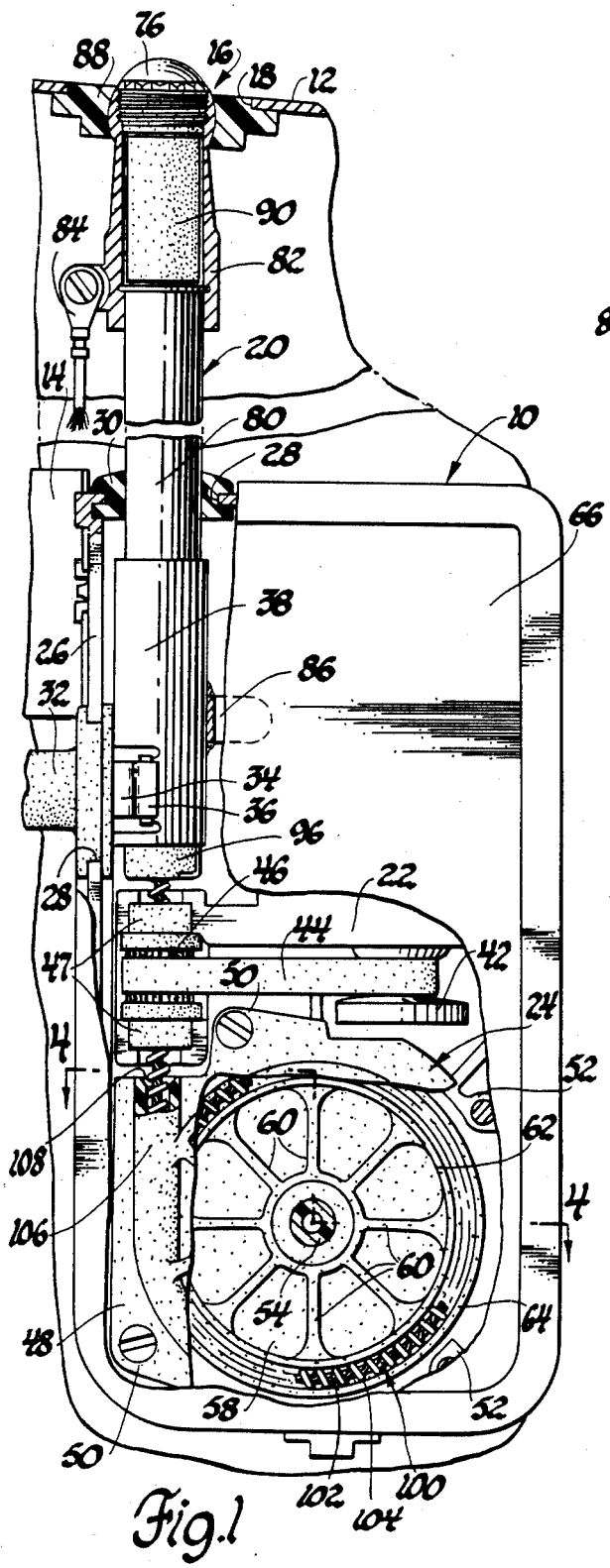
FIG. 1 is a fragmentary elevational view partially broken away and showing a radio antenna 20 according to the invention withdrawn to a fully retracted position.
Figure 2:
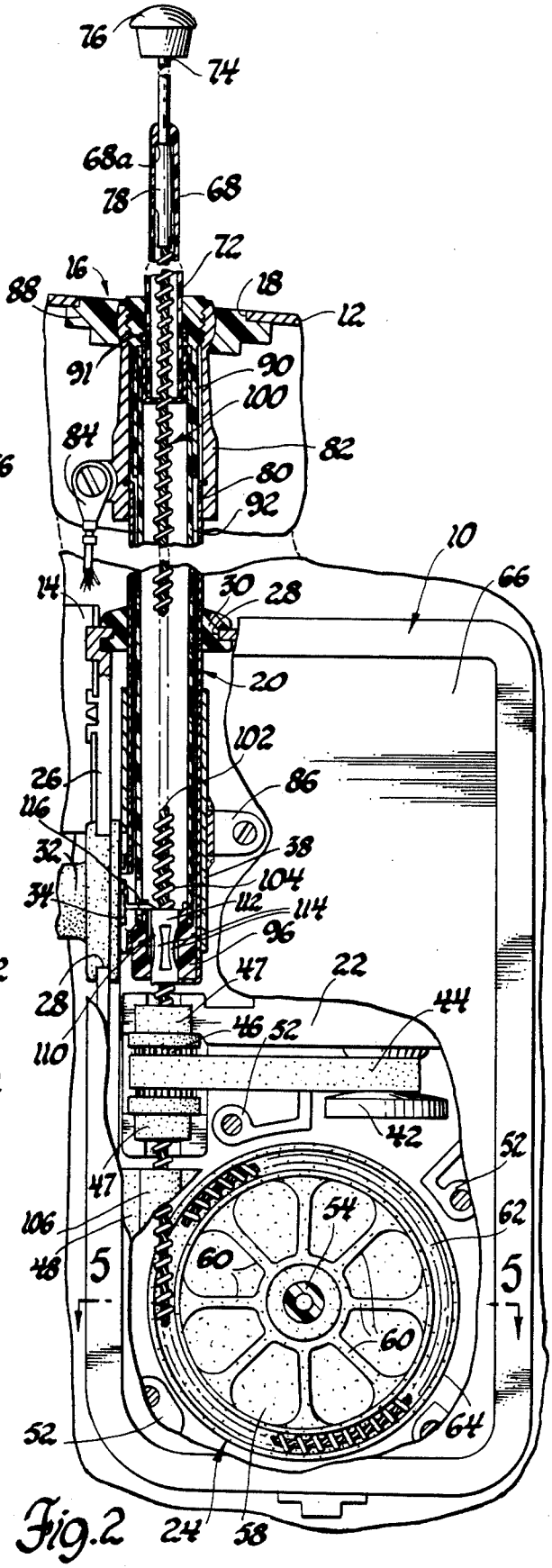
FIG. 2 is a view similar to FIG. 1 but even further broken away and showing the antenna in a fully extended position.

Referring now to FIGS. 1 and 2, the power antenna designated generally as 10 is adapted for mounting in an interior space of a vehicle body underneath, for example, a front fender or rear quarter panel member indicated at 12. The attachments at the vehicle body interior include one or more brackets 14 for the lower housing portion, and an upper ball-like mounting assembly 16, later to be described, secures the upper end of antenna 10 in an aperture 18 of fender 12.

Figure 6:
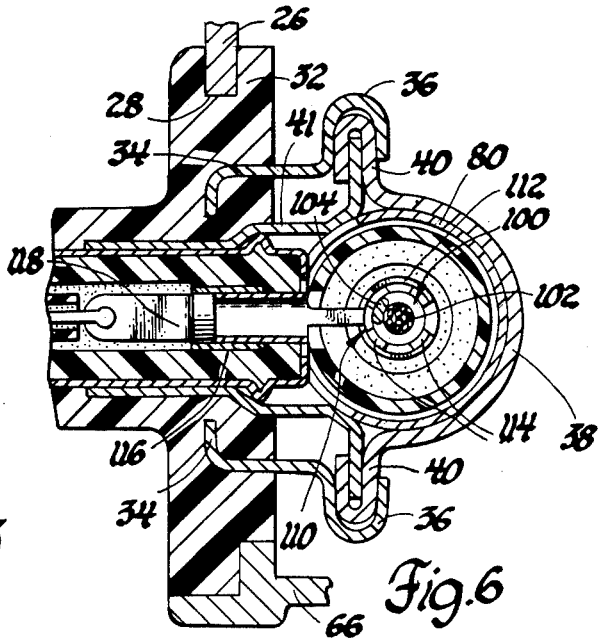
FIG. 6 is an enlarged sectional view down along the plane indicated by lines 6—6 of FIG. 3.

Consistent with simplicity and ruggedness of construction intended in this preferred embodiment of the invention, antenna 10 is constructed of a plurality of easily integrated subassemblies or subunits including a mast tubes unit 20, a motor drive unit 22 and a storage drum unit 24, all assembled within a housing 26. The housing is preferably prefabricated of die cast aluminum or similar light weight metallic material providing a relatively deep rectangular cavity for receiving the various units 20, 22 and 24. In particular, the mast tubes unit 20 is received within open-end slots 28 in the top and an adjacent side wall of housing 26 and held therein by grommets 30 and 32 each captured in the edges of the respective slot 28 and fabricated of suitable polymeric material exhibiting substantial dielectric or electrically insulative properties. The grommet 32 in the side wall slot is, as seen best in FIG. 6, further constructed with an embedded metallic retainer 34 having flanges 36 which may be crimped over the ears 40 of a retainer sleeve 38 welded to the lower portion of mast tubes unit 20. Ears 40 further capture suitable flanges of a tubular RF cable connector metallic retainer 41.

Motor drive unit 22 comprises a motor frame, not shown in detail, suitably affixed to the interior wall of housing 26 to one side of the mast tubes unit 20. The motor of unit 22 is preferably of the permanent magnet type, reversible in operation and the drive shaft of which carries a pulley 42 connected by endless belt 44 to a drive nut 46 suitably rotatably mounted in plastic bearings 47 on the frame of the unit 22 directly beneath the end of the mast tubes unit 20.

Figure 4:
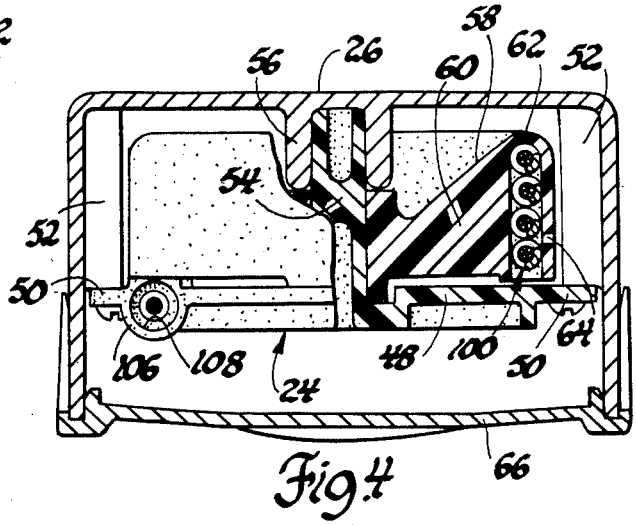
FIG. 4 is an enlarged sectional view taken along the planes indicated by the lines 4—4 of FIG. 1.
Figure 5:
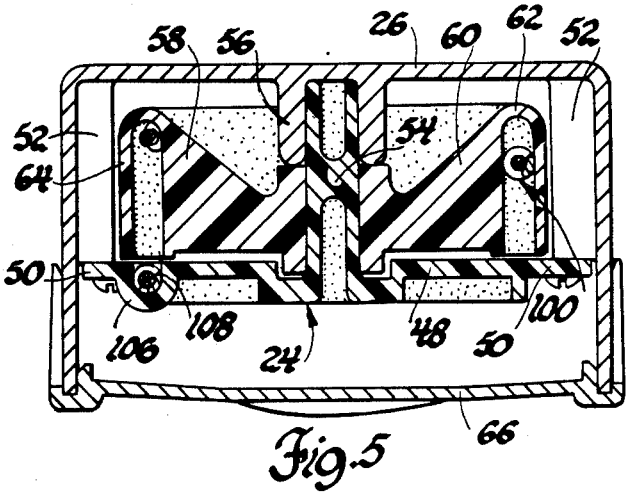
FIG. 5 is an enlarged sectional view down along the plane indicated by lines 5—5 of FIG. 2.

The storage drum unit 24 comprises a cover and guide member 48 with a flat body portion apertured as at 50 in various locations to be attached by screws to underlying supporting ribs 52 cast into the walls of the housing 26, as seen best in FIGS. 4 and 5. The drum cover 48 includes an integral depending stem 54 received within a centrally bored boss 56 of the housing 26. Also, reverting to FIG. 2, stem 54 rotatably mounts underneath the member 48 a cable drum 58 of molded construction having a series of angularly spaced webs 60 radiating from its central hub to an enlarged cable-receiving annular portion 62 having a deep cavity partially defined by a cylindrical outer drum wall 64. Both the cable drum 58 and cover and guide member 48 are fabricated of a suitable electrically insulative material such as medium impact polypropylene.

The assembly of these various units 20, 22 and 24 with housing 26 is completed by the installation of a housing cover 66, which may again be constructed of cast aluminum or sheet steel, or of a metallized polymeric construction which may preferably have integrally formed retainer tabs that snap over outer edges of the housing 26 for cover retention.

Figure 3:
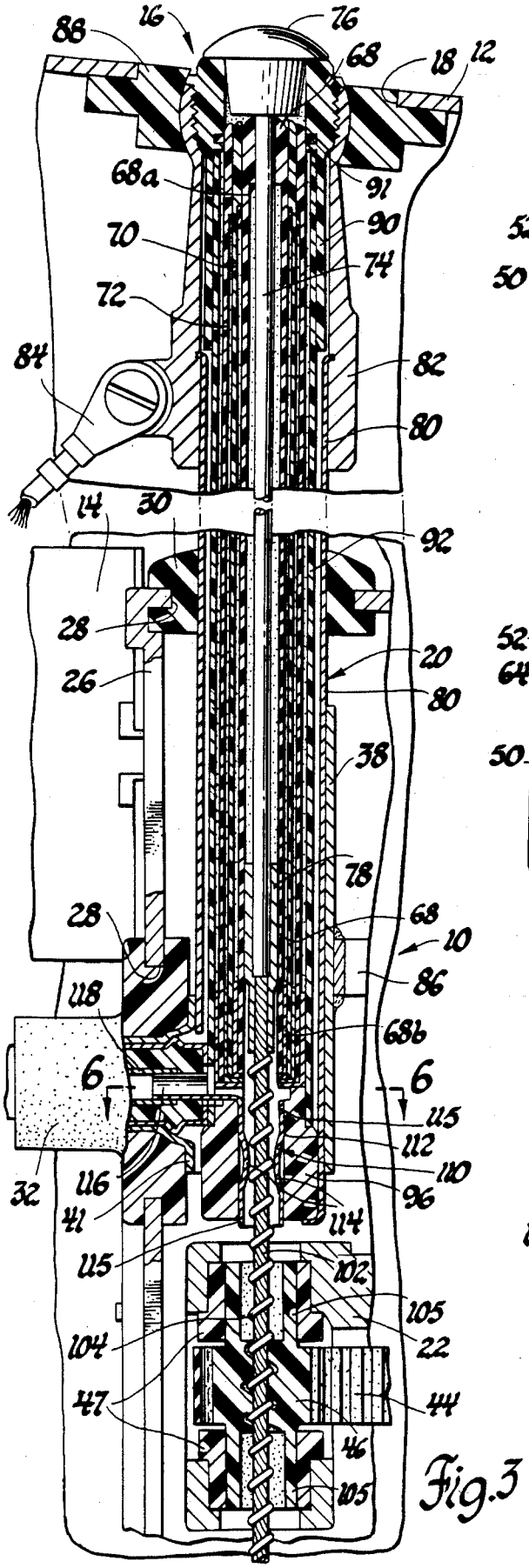
FIG. 3 is an enlarged view of a portion of FIG. 1 and further broken away.

Referring now to FIG. 3, the mast tubes unit 20 in accordance with the objectives of this invention contain sheath tubes fabricated of a tough but flexible polymer that will withstand impact or continuous stress from engagement with such hazards as garage doors, auto wash mechanisms and the like. The tubes comprise an innermost sheath 68 and intermediate and outer sheaths 70 and 72. A preferred material for these sheath tubes is a fiberglass reinforced thermoset polymer featuring filament wound construction. As seen in the upper portion of FIG. 3, the upper end of each such sheath tube 68, 70 and 72 is preferably molded with an inturned shoulder, such as shoulder 68*a*. Alternatively, the shoulder may be provided by insertion and bonding of a short plastic sleeve in the otherwise continuous diameter or if desired, slightly tapered, sheath stock. As is conventional, these shoulder configurations provide for sequential extension and retraction in telescopic manner of the sheath tubes upon extension or retraction of the innermost sheath 68. For such action, a lower shoulder configuration on the tubes, seen best in the lower portion of FIG. 3, comprise successively overlapping sheet metal cups bonded or staked over the lower end of each successive larger tube, as for example smallest cup 68b on the lower end of sheath tube 68.

An inner antenna rod 74 of stainless steel is received telescopically within innermost sheath tube 68 and is threaded at its upper end to receive a conventional finial 76. Adjacent its lower end, the rod is welded or otherwise secured within a central bore of a coupling sleeve 78 of stainless steel or like material. Upon extension of the antenna mast assembly to a deployed position above the fender 12, the upper end of coupler 78 will move upwardly to strike shoulder 68a of sheath tube 68 and further such extension of the rod 74 upwardly will successively engage the opposed shoulders of the remaining sheath tubes until the mast tubes unit reaches the fully extended and deployed position represented in FIG. 2.

For retraction of the antenna mast tubes back to the storage position of FIGS. 1 and 3, inward retraction of rod 74 causes finial 76 to engage the upper end of sheath tube 68 followed by successive engagement of the successively overlapped lower cups 68b etc. and continued motion until the mast unit is fully retracted.

Rod 74 and the sheath tubes of the mast unit 20 are adapted for nesting within a large diameter shield tube 80, the lower end of which has attached thereto the aforementioned retaining sleeve 38. Both the shield tube and the retaining sleeve are fabricated of steel or like metal to serve as a barrier to electromagnetic radiation when properly grounded. Thus, at the upper end of the shield tube there is affixed by staking, screws, or the like an upper sleeve combination 82 of die cast zinc or the like and either the sleeve 82 or the upper end of the shield tube 80 is connected by a ground strap 84 to fender 12 or adjacent vehicle body sheet metal structure at ground potential within the vehicle body. A similar ground strap connection 86 is provided between the lower end of the shield tube 80 and a wall of housing 26, FIG. 2.

Any number of suitable attachment means at fender 12 are acceptable for the upper end of sleeve 82, but in a preferred embodiment the upper extremity of sleeve 82 is formed spherically for push-in assembly within a socket-like cavity of a polymeric mounting member 88 suitably secured to fender 12, whereby the antenna 10 is easily oriented in various attitudes relative to fender 12 from car style to car style while secured therewithin by said brackets as 14. The upper end mount assembly further comprises an insulator sleeve 90 of polymeric material joined as by threads to the ball portion of sleeve 82 and having close sealing engagement, as at plastic ring 91, with the outermost sheath tube 72 to prevent ingress of moisture, etc. A stationary tube 92 of electrically insulative polymer material extends from insulator sleeve 90 protectively over the sheath tubes assembly throughout the length of shield tube 80.

At the lower end of shield tube 80, the mast tubes unit 20 further comprises a lower sleeve 96 of relatively thick polymeric material with substantial electrically insulative properties, such as medium impact polypropylene. As will be later described, sleeve 96 serves to mount a cable guide and radio frequency cable connector assembly.

The axis of shield tube 80 defines an operative axis in accordance with this invention for extension and retraction of the antenna by use of a cable assembly 100 which serves not only as an actuating drive element but also as the radio wave collector or receptor. Cable 100 has been found to be best constructed of a multiple layer of steel wire including a monofilamentary wire or core of high tensile steel with a brass coating, and a series of helically wrapped additional such wire layers, all for the purpose of providing a tough actuating cable that will withstand repeated sequences of powered antenna extension and retraction in the severely varied weather conditions to which automobiles are typically subjected. Yet, such cable must be sufficiently flexible to withstand impacts or force from engagement of such hazards as garage doors, etc. Further, it is desired that it exhibit a substantial self-sustaining stiffness or elevated elastic modulus. When deployed as an antenna within the extended sheath tubes, the combination should maintain its normally straight form even in moderate winds. When the cable is wound on storage drum 58, as will be described, it should exhibit significant uncoiling force. In a preferred construction, the center core wire is of 0.3 mm diameter and a first helical wrap thereover comprises four strands or starts of individual brass coated high-tensile steel wire laid helically side by side with a pitch of 1.7 mm, the diameter of each start or strand being 0.3 mm. A second helical wrap again comprises four wire strands or starts of 0.3 mm of high tensile brass-coated steel wire helically wound side by side in a layer having the opposite helical hand to the first overlayer. This second helical layer is apparent in the Figures, as indicated at 102. Finally, a larger pitch single wire helical overlayer is made in the same helical hand as the first overlayer and indicated at 104. This is of a larger diameter (1.0 mm) high tensile uncoated steel wire structure laid with a helix pitch of 2.5 mm. Here, a brass coating may be avoided in favor of the surface application thereto of suitable electrically conductive molybdenum filled grease.

The upper end of cable 100 is welded or otherwise affixed within the bore of the lower end of coupler 78 on rod 74, FIG. 3, thus constructing a cable and rod unit serving as the radio wave receptor. The cable 100 is received for meshed engagement within the helically grooved central bore of the drive nut 46, and for this purpose the drive nut is aligned on the operative axis for cable 100 defined by shield tube 80. The helical grooving of the drive nut is closely diametrically sized to and matches the helical pitch of outer wrap 104 of the cable, again as seen best in FIG. 3.

The drive nut 46 is fabricated of an electrically insulative thermoplastic polymer such as polyester and as seen in such Figure, includes a pair of axial extensions 105 journaled in the two plastic bearings 47 supported on motor unit 22. Thus, the drive nut and the elastomered material drive belt 44 provide no direct path for electromagnetic disturbances to cable 100, nor any appreciable capacitive coupling of such cable with adjacent metallic structure.

Referring to FIG. 1, the cable 100 further extends along such operating axis of shield tube 80 to enter a tapered entrance guide bore 108 molded within a raised portion 106 of cover 48 and aligned on such operating axis upon installation of the latter in the housing 26. Such bore 108 gradually deviates from such axis downwardly (FIG. 4) toward and opens into the cylindrical cavity of cable drum 58 whereby to direct movement of the cable to and from a coiled configuration within such drum.

Thus, lower insulator sleeve 96 and guide bore 108 of portion 106 serve as spaced guide elements of electrically-insulative material situated on the operating axis of shield tube 80 for directing translation of the cable 100 therethrough from the coiled condition of FIG. 1 to the substantially uncoiled and extended condition of FIG. 2, and vice versa. This guidance arrangement prolongs the life of the cable in service. Such translation of the cable 100 is achieved by selected powered rotation in opposite directions of drive nut 46 by motor unit 22, such being accomplished by conventional power switching integrated in the radio receiver. When the antenna reaches its fully deployed position in FIG. 2 or the fully retracted position of FIGS. 1 and 3, various means may be utilized to automatically halt motor operation but it is preferred that a Hall probe device be integrated with the drive pulley of the motor unit either to precisely count the rotations of the drive nut between the antenna extended and retracted positions, or sense stall thereof, and automatically halt the motor.

It is essential that powered rotation of the drive nut 46 not be accompanied by co-rotation of cable 100 on its own axis as can arise, for example, from normal friction in the helical grooves of drive nut 46. By the present invention, this is avoided by maintaining a predetermined length of cable 100 coiled within storage drum 58 in all positions of the antenna unit. Thus, as seen in FIG. 2, with the cable construction as above described and a storage drum diameter of about 60 mm at the inside surface of wall 64, it has been found that with about one full turn of cable 100 resiliently and frictionally engaged against such outer wall 64, sufficient frictional engagement is present in the lower extremity of cable 100 to create a torsional resistance to co-rotation of the cable with the drive nut when the motor unit is energized to retract the antenna back to the position of FIG. 1. Of course, similar and greater frictional resistance is present when the cable 100 is even further coiled within the storage drum when in the latter position. The length or number of stored coil turns or fractions thereof in cable 100 necessary to this expedient will of course within our ordinary skills vary somewhat with the diameter and material properties of storage drum 58, and also with variations from the above specified characteristics of the cable construction.

It is further to be observed that by these expedients the assembly of the various subunits of the antenna unit 10 is enhanced. An improved assembly method thus derives from first mounting within housing 26 the mast tubes unit 20 while the various sheath tubes and cable 100 are preliminarily extended to some moderate length with the lower end of cable 100 just juxtaposed to the top of the previously installed motor and drive nut unit. Manual insertion of that lower end of the cable into the drive nut, while the latter is rotating under power in the appropriate direction, will quickly and easily feed the cable through the drive nut and through guide bore 108 into storage drum 58 until cable 100 and all sheath tubes are fully withdrawn into the retracted condition shown in FIG. 1, whereupon the assembly person will halt motor operation. Such expedited assembly procedure is complemented by the fact that no additional retention devices are required in the storage drum for the end of the cable 100 which might detract from the radio reception and transmission features of construction provided for cable 100 by this invention.

Thus, by the present invention, further advantage is achieved for radio reception performance in that the radio reception element embodied in cable 100 may effectively direct the received radio waves to an RF cable and radio receiver via a single contact point. Thus, there is provided within the central bore of lower sleeve 96 a combined cable guide and feedline contact ferrule 110, seen best in FIGS. 3 and 6. It is essentially of tubular construction, including a first portion 112 of a diameter sized closely to the outer helical wrap 104 of cable 100 and including lanced inwardly bowed contact strips 114. These strips are preferably resiliently force fit over the wrap 104 and the ferrule material is preferably of tempered phosphor bronze. The ferrule is aligned on the operating axis defined by shield tube 80 and acts as the cable guide at the lower end of the shield tube. The ferrule 110 further includes a terminal portion 116 bent at a right angle from portion 112, again of tubular form mated with the female connector end 118 of a conventional coaxial RF wire and ground sheath feedline cable assembly integrated with the grommet 32. Such cable connector end 118 is of course conventionally fitted with a conductive outer shell element on its ground sheath which is here placed in contact with the grounded retainer tube 41 mounted to shield tube 80. Thus, it will be appreciated that the RF cable assembly can be integrated with the mast tubes unit 20 in a variety of ways within the improved assembly procedure described above prior to the powered feeding of cable 100 into the storage drum.

The radio reception performance of the antenna unit 10 derives maximum benefits from the organization of elements hereinabove described. In addition to but a single sliding contact point for cable 100 at ferrule portion 112, the ferrule portion 112 itself is of substantially the diameter of cable 100 and substantially smaller than shield tube 80, with only slight flaring at its ends 115 to aid in cable assembly operations, FIG. 3. Capacitive coupling with the shield tube is thereby avoided, i.e., the ratio of the diameters of the two elements prohibits shield tube 80 itself acting effectively as a receptor in conjunction with cable 100. The shield tube 80, while indeed maintained at ground potential, is distant and isolated from cable 100 by substantial thickness of insulative media including the upper and lower insulative sleeves, the sheath tubes, and the stationary tube 92.

Further, the housing 26 and its cover 66 when assembled with shield tube 80 effectively shield the entire length of cable 100 from ambient electromagnetic radiation except for that portion thereof deployed above fender 12. The length of such portion together with rod 74 has generally been found to require 1 meter of effective length. The remainder of the cable situated below the ground plane of fender 12 may, depending on various car styles, be of substantial additional length but does not constitute an undesirable receptor either by direct unshielded exposure to such radiation or subject to capacitive coupling with those elements which are grounded as aforementioned.

The embodiments of the invention in which an exclusvie property or privilege is claimed are defined as follows:

1. A power actuated telescoping antenna deployable between extended and retracted positions, comprising, a multi-section telescopic tubular sheath assembly, a length of helically wound push/pull cable fabricated with substantial self bias to a straight figure but resilient in bending, the upper end of said cable being disposed within said sheath assembly and adapted for motion jointly with the telescopic motion of the latter, power-rotatable drive nut means meshed upon said cable and operable upon powered rotation in opposite directions to extend and retract said cable and said sheath assembly, a storage drum receiving the lower end of said cable and including an outer wall, said cable lower end being free of attachment to said drum except by frictional engagement with said outer wall, said drum in all positions of said antenna containing at least a predetermined length of said cable resiliently coiled against said outer wall of the drum whereby, solely from the frictional engagement of said cable thereagainst, said drum acts as a brake against rotation of said cable upon its own axis during powered rotation of said nut.

2. A power actuated telescoping antenna deployable between a retracted position below a ground plane support surface and an extended position thereabove, comprising, a series of telescopically related mast sections of polymeric substantially electrically insulative material enclosing an inner electrically conductive push/pull cable, a drum of polymeric substantially electrically insulative material adapted for coiled storage therewithin of said cable, power operated means for extending and retracting said cable, an electrically grounded metallic shield tube with a lower end for enclosing below said ground plane said mast sections and the portion of said cable which is contained within the shield tube, a metallic shield housing assembly with the lower end of said shield tube and enclosing said drum and said power-operated means and the remainder of the portion of said cable which is situated below said ground plane, means insulating said cable from said shield tube and housing assembly, and combined cable guide and radio frequency energy collector feedline means disposed within said shield tube and housing assembly and including a metallic tubular guide and contact member of substantially the diameter of said cable engaged in rubbing contact thereover.

3. A power actuated telescoping antenna deployable between extended and retracted positions, comprising, a multi-section telescopic sheath assembly, a length of helically wound push/pull cable fabricated with substantial self bias to a straight figure but resilient in bending, the upper end of said cable being disposed within an innermost section of said sheath assembly and adapted for motion jointly with the telescopic motion of the latter, power-rotatable drive nut means meshed upon said cable and operable upon powered rotation in opposite directions to extend and retract said cable and said sheath assembly, a storage drum receiving the lower end of said cable and including an outer substantially cylindrical wall, said cable lower end being free of attachment to said drum except by frictional engagement with said outer wall, support means mounting said drum for rotation and including a cable guide co-axially aligned with said nut to guide said cable to and from said drum through said nut, said drum in all positions of said antenna containing at least a predetermined length of said cable resiliently coiled against said outer wall of the drum whereby, solely from the frictional engagement of said cable thereagainst, said drum acts as a brake against rotation of said cable upon its own axis during powered rotation of said nut.

4. A power actuated telescoping antenna deployable between a retracted position below a ground plane support surface and an extended position thereabove, comprising, a series of telescopically related mast sections of polymeric substantially electrically-insulative material enclosing a length of electrically conductive helically wound push/pull cable fabricated with substantial self bias to a straight figure and attached at one end thereof to the innermost mast section, the other end of said cable being received freely upon a storage drum of polymeric substantially electrically-insulative material, power operated means including a drive nut of substantially electrically-insulative material, a guide element of electrically-insulative material guiding said cable between said drive num and said drum, an electrically grounded metallic shield tube for enclosing below said ground plane said mast sections and the portion of said cable which is contained within the shield tube, said drive nut being disposed below said shield tube in driving engagement with said cable for extending and retracting the latter and said mast sections along the axis of said shield tube, metallic housing means assembled with said shield tube and supporting and enclosing said drive nut and said guide element substantially on said axis and further enclosing said drum and the remainder of the portion of said cable which is situated below said ground plane, and combined cable guide and radio frequency energy collector feedline means disposed within the lower end of said shield tube and comprising an electrically-insulative sleeve secured in the latter and in turn mounting generally upon said axis a metallic tubular guide and contact member of substantially the diameter of said cable and engaged in rubbing contact thereover.

* * * * *